US006926294B2

(12) United States Patent
Lewis

(10) Patent No.: US 6,926,294 B2
(45) Date of Patent: Aug. 9, 2005

(54) OFF-ROAD IN-LINE TWO WHEELED SKATEBOARD

(76) Inventor: Michael G. Lewis, Box 173, Calista, British Columbia (CA), V0E 1L0

( * ) Notice: Subject to any disclaimer, the term of this patent is extended or adjusted under 35 U.S.C. 154(b) by 0 days.

(21) Appl. No.: 10/685,524

(22) Filed: Oct. 16, 2003

(65) Prior Publication Data

US 2004/0080130 A1 Apr. 29, 2004

Related U.S. Application Data

(60) Provisional application No. 60/418,710, filed on Oct. 17, 2002.

(51) Int. Cl.[7] ..... B60M 1/00
(52) U.S. Cl. ..... 280/87.042; 280/87.041
(58) Field of Search ..... 280/87.042, 87.041, 280/11.221, 11.233, 11.25, 11.19, 275, 276, 283, 277, 284, 286

(56) References Cited

U.S. PATENT DOCUMENTS

| | | | | | |
|---|---|---|---|---|---|
| 1,194,102 | A | * | 8/1916 | Webb | 280/11.19 |
| 1,279,966 | A | * | 9/1918 | Baker | 280/87.042 |
| 1,850,348 | A | | 3/1932 | Harley | |
| 3,620,547 | A | * | 11/1971 | Vaverek | 280/87.042 |
| 3,853,069 | A | | 12/1974 | Goodwin | |
| 3,860,264 | A | | 1/1975 | Douglas et al. | |
| 3,990,716 | A | | 11/1976 | Dows | |
| 4,108,460 | A | | 8/1978 | Silva, Jr. | |
| 4,127,282 | A | | 11/1978 | Gorlach et al. | |
| 4,394,029 | A | | 7/1983 | Holmgren | |
| 4,558,878 | A | | 12/1985 | Motrenec | |
| 4,645,223 | A | | 2/1987 | Grossman | |
| 4,700,963 | A | | 10/1987 | Burns et al. | |
| 4,773,514 | A | | 9/1988 | Gustafsson | |
| 4,925,198 | A | | 5/1990 | Ito et al. | |
| 5,157,987 | A | | 10/1992 | Satoh et al. | |
| 5,160,155 | A | * | 11/1992 | Barachet | 280/87.042 |
| 5,383,676 | A | | 1/1995 | Valentino | |
| 5,492,033 | A | | 2/1996 | Hopey | |
| 5,826,674 | A | * | 10/1998 | Taylor | 280/87.042 |
| 5,836,213 | A | | 11/1998 | Hopey | |
| 5,860,657 | A | * | 1/1999 | Kroher | 280/11.223 |
| 5,927,740 | A | | 7/1999 | Hopey | |
| 5,950,754 | A | | 9/1999 | Ondrish, Jr. | |
| 5,954,349 | A | * | 9/1999 | Rutzel | 280/87.041 |
| 5,997,018 | A | | 12/1999 | Lee | |
| 6,145,637 | A | | 11/2000 | Hopey | |
| 6,241,264 | B1 | | 6/2001 | Page | |
| 6,341,790 | B1 | | 1/2002 | Chen | |
| 6,488,295 | B1 | * | 12/2002 | Bryant | 280/87.042 |
| 2001/0015539 | A1 | | 8/2001 | Stewart | |
| 2001/0028155 | A1 | | 10/2001 | Way, II et al. | |

FOREIGN PATENT DOCUMENTS

| | | |
|---|---|---|
| CA | 2287433 | 10/1998 |

* cited by examiner

*Primary Examiner*—Hau Phan
(74) *Attorney, Agent, or Firm*—Anthony C. Edwards

(57) ABSTRACT

An in-line wheel, all-terrain skateboard includes an elongate rigid frame having a forward member. The forward member has a front end and an opposite rear end. A laterally spaced apart pair of rigid struts defining a rear wheel well therebetween is rigidly mounted to the rear end, so as to extend rearwardly from the forward member. A headset is rigidly mounted to the forward end of the forward member. At least one front fork is rotatably mounted to the headset for rotation about a front fork axis of rotation. A front wheel is rotatably mounted to the at least one front fork for rotation about a front wheel axis of rotation. The front wheel axis of rotation is orthogonal to, and offset forwardly from, the front fork axis of rotation. The front fork axis of rotation is inclined rearwardly from the front wheel.

15 Claims, 7 Drawing Sheets

OFF-ROAD IN-LINE TWO WHEELED SKATEBOARD

CROSS REFERENCE TO RELATED APPLICATION

This application claims priority from U.S. Provisional Patent Application No. 60/418,710 filed Oct. 17, 2002 entitled Off-Road In-Line Two Wheeled Skateboard.

FIELD OF THE INVENTION

This invention relates to the field of skateboards generally, and in particular to an in-line two wheeled skateboard, designed primarily for use over uneven terrain, which includes a foot deck mounted below the wheel rotational axes, independent suspension for both the front and rear wheels, and an articulated front wheel having an adjustable centering and damping mechanism.

BACKGROUND OF THE INVENTION

With the advent of many forms of recreational pursuits being transferred from the comparative uniformity of the street to more rugged and wilderness settings, appropriate design modifications are required to the corresponding recreational vehicle to be viable for use in such settings and to ensure safe and durable operation. For example, the familiar "street" bicycle has evolved into the more substantial "mountain" bike and the familiar "street" skateboard, which operates on the relatively smooth and rigid surface of a roadway, must undergo substantial alteration for proper operation on more rugged terrain.

The conventional street skateboard usually has fore and aft wheel pairs, which are mounted in laterally opposed pairs to the underside of the skateboard deck on trucks, or axle assemblies. The trucks consist of a base plate and an axle and wheel assembly, which is pivotally mounted on to the base plate. The wheels, which are generally mounted in fore and aft pairs, are of relatively small diameter and have a rotational axis that is substantially below the skateboard deck. The small diameter wheels provide only limited ground clearance and when mounted in fore and aft pairs are manoeuvred by twisting or pivoting the board about its longitudinal axis.

It is therefore an object of this invention to provide an in-line skateboard suitable for use over relatively rough and hilly terrain, having a single fore and aft pair of relatively large diameter wheels positioned near the fore and aft ends of the skateboard, each wheel in-line with the longitudinal axis of the board and where the laterally extending axis of rotation of each wheel is located above the skateboard deck.

It is a further object of this invention to permit independent vertical movement of the fore and aft wheels relative to the board deck, as may result during travel over rough terrain, without resulting in corresponding undamped vertical movement of the skateboard deck.

SUMMARY OF THE INVENTION

The present invention is an in-line skateboard having a frame to which front and rear decks or footpads are secured. A steering tube at the forward end of the frame rotatably supports a front fork and a front wheel assembly containing a built-in shock absorbing mechanism for rotation of the fork about an upwardly extending axis of rotation. A progressive damping and centering device is mounted between the front forks and the frame for damping rotation of the fork and for urging the fork to return to a centered orientation aligned with the longitudinal axis of the board. The centering device is readily adjustable for both the initial alignment of the front wheel and for progressive wheel control during a turn.

A pair of trailing swing arms are pivotally mounted to a center portion of the frame. The rear wheel is mounted between the distal ends of the swing arms. The swing arms lie above and in vertical alignment with the rearwardly extending rear wheel-well strut portions of the frame. Shock absorber connecting rods are pivotally mounted to the rear wheel-well strut portion of the frame. The rods are journalled through apertures in the trailing swing arms. Each rod is mounted at its upper end to an adjustable tensioning mechanism mounted one on each swing arm and at its lower end to the rear wheel-well strut portions of the frame. An "L"-shaped (when viewed in side elevation) rear brake mounting bracket is pivotally mounted to the rear wheel axle at the bend in the "L"-shape of the bracket. The bracket extends rearwardly from the rear wheel axle, on opposite sides of the rear wheel, and wraps around the rear of the rear wheel in a "U"-shape (when viewed from above). An adjustable tie rod is, at one end, pivotally mounted to the opposite end of the "L"-shaped bracket. The opposite end of the tie rod is mounted to the rear wheel well strut portions of the frame. Brake callipers are mounted on the rear brake mounting bracket so as to engage opposite sides of the rim of the rear wheel.

In summary, the in-line wheel, all-terrain skateboard of the present invention includes an elongate rigid frame having a forward member. The forward member has a front end and an opposite rear end. A laterally spaced apart pair of rigid struts defining a rear wheel well therebetween is rigidly mounted to the rear end, so as to extend rearwardly from the forward member.

A headset is rigidly mounted to the forward end of the forward member. At least one front fork is rotatably mounted to the headset for rotation about a front fork axis of rotation.

A front wheel is rotatably mounted to the at least one front fork for rotation about a front wheel axis of rotation. The front wheel axis of rotation is orthogonal to, and offset forwardly from, the front fork axis of rotation. The front fork axis of rotation is inclined rearwardly from the front wheel, advantageously in one embodiment about twenty-two degrees from the vertical.

A resilient turning-resistance means is provided for resiliently resisting the rotation of the front forks about the front fork axis of rotation. The turning-resistance means is mounted in cooperation between the front forks or at least one of the front forks, and the forward member of the frame. The resilient turning-resistance means may include means for exerting a first degree of resistance during rotation of the headset through a first rotational range of motion about the front fork axis of rotation, and means for exerting a second degree of resistance, greater than the first degree of resistance, during rotation of the headset through a second rotational range of motion about the front fork axis of rotation when the headset is rotated past the first rotational range of motion, the second rotational range of motion being greater than the first rotational range of motion.

A pair of swing arms is pivotally mounted at first ends thereof to the rear end of the frame, above the pair of rigid struts, so as to extend rearwardly from the forward member. A rear wheel is rotatably mounted to an opposite second end of the pair of swing arms. The rear wheel is mounted for rotation about a rear wheel axis of rotation which is substantially orthogonal to the swing arms.

Rigid fore and aft foot platforms are mounted, respectively, between the front and rear wheels and rearwardly of the pair of rigid struts. The rider thus stands astride the rear wheel. The fore and aft foot platforms are mounted below both the front wheel axis of rotation and the rear wheel axis of rotation.

In a preferred embodiment a brake mounting bracket is mounted to the second ends of the pair of swing arms. A wheel brake is mounted to the brake mounting bracket. Advantageously, the brake mounting bracket is pivotally mounted to the second ends of the swing arms. The wheel mounting bracket may extend downwardly from the second ends to lowermost ends of the swing arm, which may be "L"-shaped. A pair of parallelogram members may be pivotally mounted at a forward end thereof to the pair of rigid struts and pivotally mounted at their opposite rearward ends to the lowermost ends of the swing arms so that the pair of parallelogram members extend, when at rest, substantially in parallel to the pair of swing arms.

At least one resilient shock absorber may be mounted in cooperation between at least one swing arm and a corresponding parallelogram member. The shock absorber may be mounted to the parallelogram member where the parallelogram member is mounted to a corresponding strut of the pair of rigid struts, or alternatively to the corresponding strut where a corresponding parallelogram member is mounted to the corresponding strut. The shock absorber is mounted in cooperation between at least one swing arm and a corresponding strut.

The shock absorber includes a resilient biasing means cooperating with a shaft or rod or the like. The resilient biasing means resiliently biases the shaft upwardly. The shaft is mounted at a lower end to the corresponding strut and at an upper end to the resilient biasing means. In one embodiment the swing arm to which the shock absorber is mounted has a substantially vertical bore therethrough. The resilient biasing means is mounted atop the bore and the shaft journalled through the bore.

DETAILED DESCRIPTION OF EMBODIMENTS OF THE INVENTION

Figure 1:
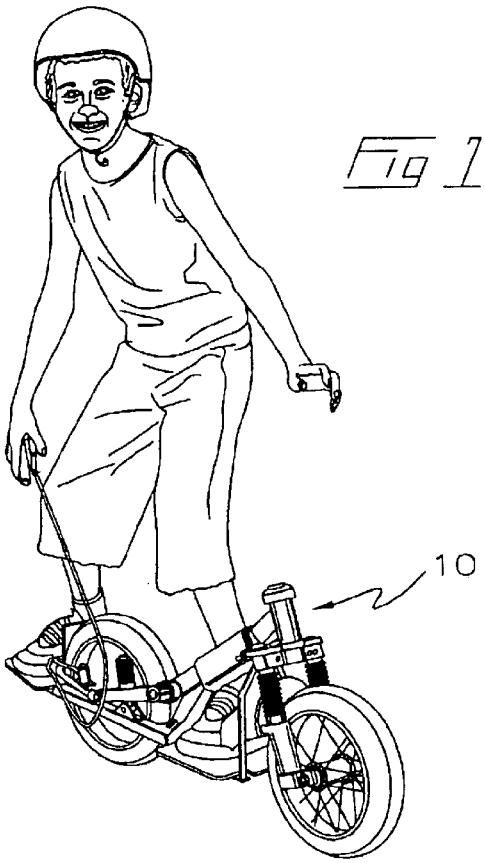
FIG. 1, is a perspective view of the skateboard of the present invention in operation.

With reference to the drawing FIGS. 1–7, wherein similar characters of reference denote corresponding parts in each view, in-line skateboard 10 includes a rigid aluminium frame 12, to which a deck comprising front and rear footpads 14 and 16 respectively, are secured. A head tube 18 is fixed to the forward end 12*a* of frame 12 so that the steering axis of the headset, generally coaxial with the rotational axis B of head tube 18, is inclined at an angle of between fifteen to thirty degrees from vertical, although, without intending to be limiting, an inclination of twenty-two degrees is preferred. The front forks 22, being parallel to head tube 18, are thus raked aft, upwardly from front wheel 26.

Front forks 22 have a built-in shock absorbing mechanism 24 which may be in the manner of conventional mountain bike front shocks. Front wheel 26 is rotatably mounted on axle 26*a* to the lower ends of front forks 22 so that tube 18 trails behind the laterally extending axis of rotation D of front wheel 26. That is, as may be seen with reference to FIG. 7, beneath axis of rotation D the vertical axis A of wheel 26 lies to the rearward of a projected rotational axis B of tube 18. Axle mounts 27 maintain axle 26*a* forwardly of front forks 22. Because of the offset of axle 26*a* from forks 22 by axle mounts 27, axis B is rearward of a parallel line C projected through the wheel axle 26*a* a distance d, of for example ⅝ inch (16 mm) measured perpendicular to axes B and C.

Figure 4:
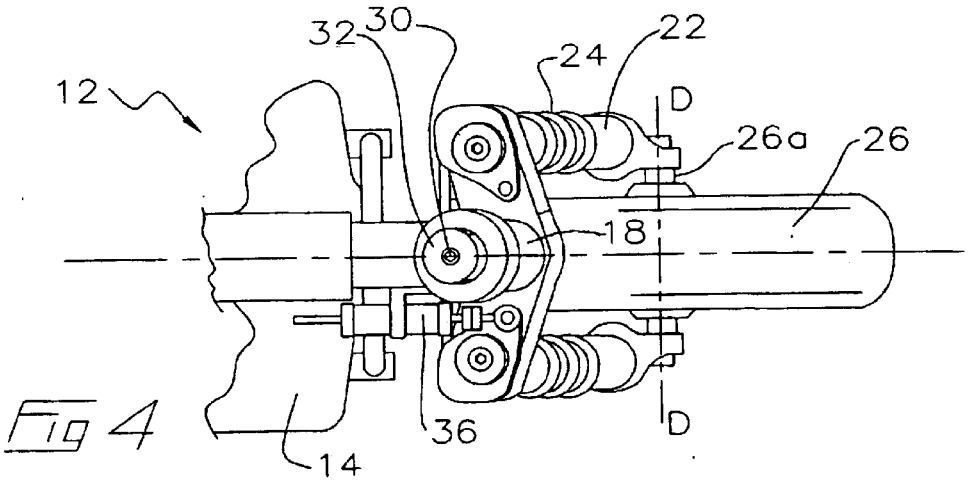
FIG. 4 is an enlarged portion of FIG. 3 showing the front wheel positioned in a straight-ahead alignment.

Front forks 22 are mounted to tube 18 through a conventional bicycle headset known in the art. In the headset, a single tube, which comprises of the upper portion of the fork, is commonly known as the steering tube. The style of headset that may be used in one embodiment is called a "threadless" headset. It is threadless because it does not require fine threads on the top of the fork's steering tube and on the upper headset bearing retaining cups. The threaded style of headset requires a large wrench to tighten. A threadless headset is comprised of a cup and cone bearing system. The cup race surrounds a ring of ball bearings and the cone race rides inside the ball's circumference. Usually the cup races are pressed into the upper and lower faces of the frame's head tube 18. The lower cone is pressed onto the fork. The upper cone sits inside the bearing ring and sits around a nylon wedge. The nylon wedge is sandwiched between the cone and the fork's steering tube. A washer, which rests against the nylon wedge, covers the top of the fork's steering tube and the headset. A threaded fitting is pressed into the upper end of the fork's steering tube. A set screw 30, labeled for reference in FIG. 4, is threaded through the washer and into the fitting. The pressed fitting acts as the screw's anchor. As the screw is tightened, the washer is forced against the wedge and the bearing assembly is tightened. Therefore, the wedge brings the cone and the fork's steering tube into union. What is unconventional is that the headset does not have a handlebar stem fastened to the fork's steering tube and has instead an extra cap 32 that surrounds the entire upper headset unit. Cap 32 is fastened as it is sandwiched between the nylon wedge and the washer.

Figure 4A:
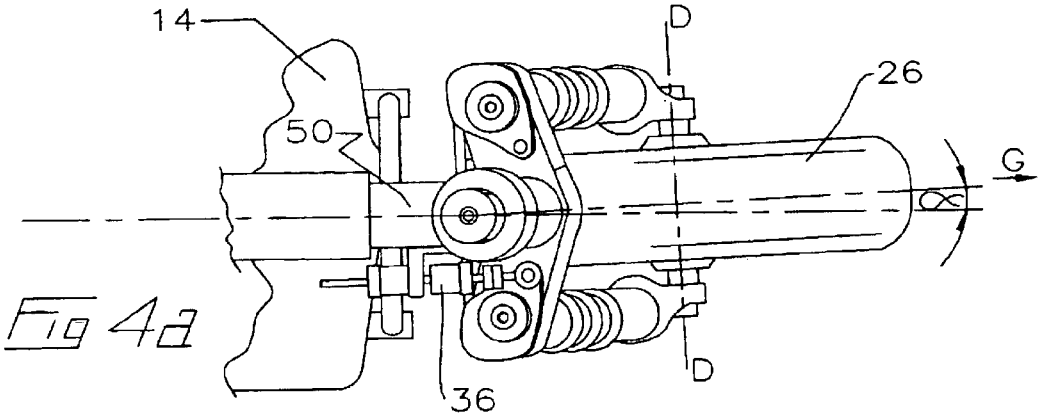
FIG. 4*a* is a plan view of the wheel of FIG. 4 turned slightly from the straight-ahead alignment.
Figure 4B:
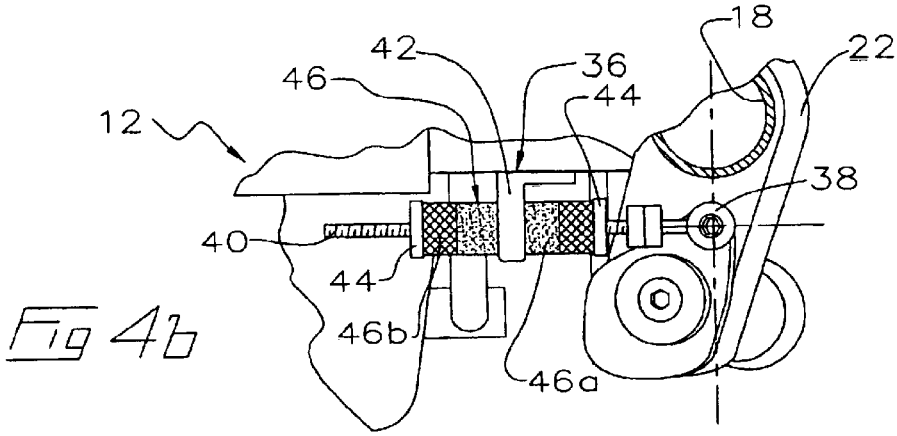
FIG. 4*b* is an enlarged plan view of the wheel damping and centering device associated with the front wheel.
Figure 5:
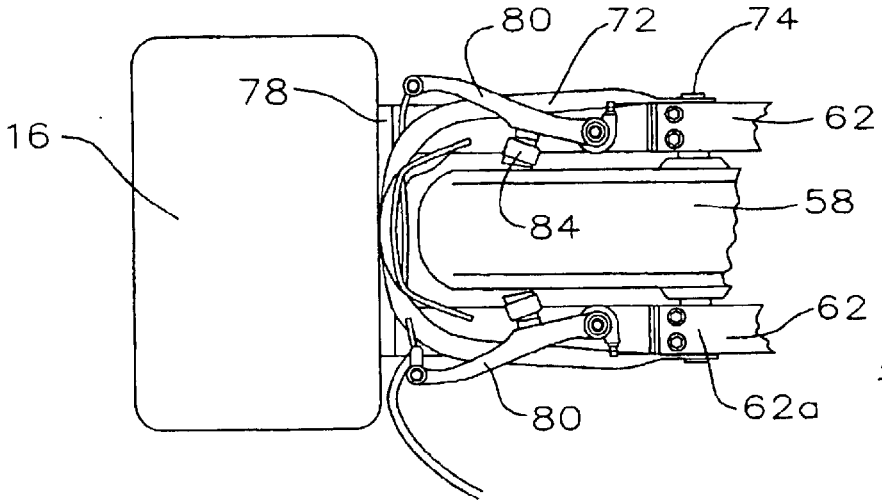
FIG. 5 is an enlarged plan view of the rear braking assembly.
Figure 6:
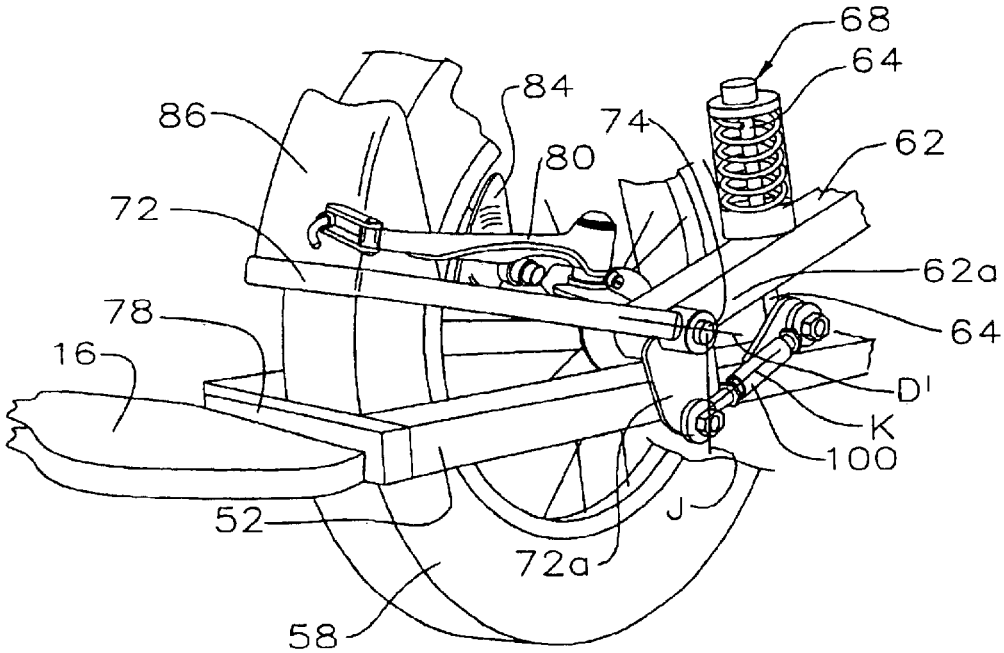
FIG. 6 is a perspective view of the rear braking assembly.
Figure 6A:
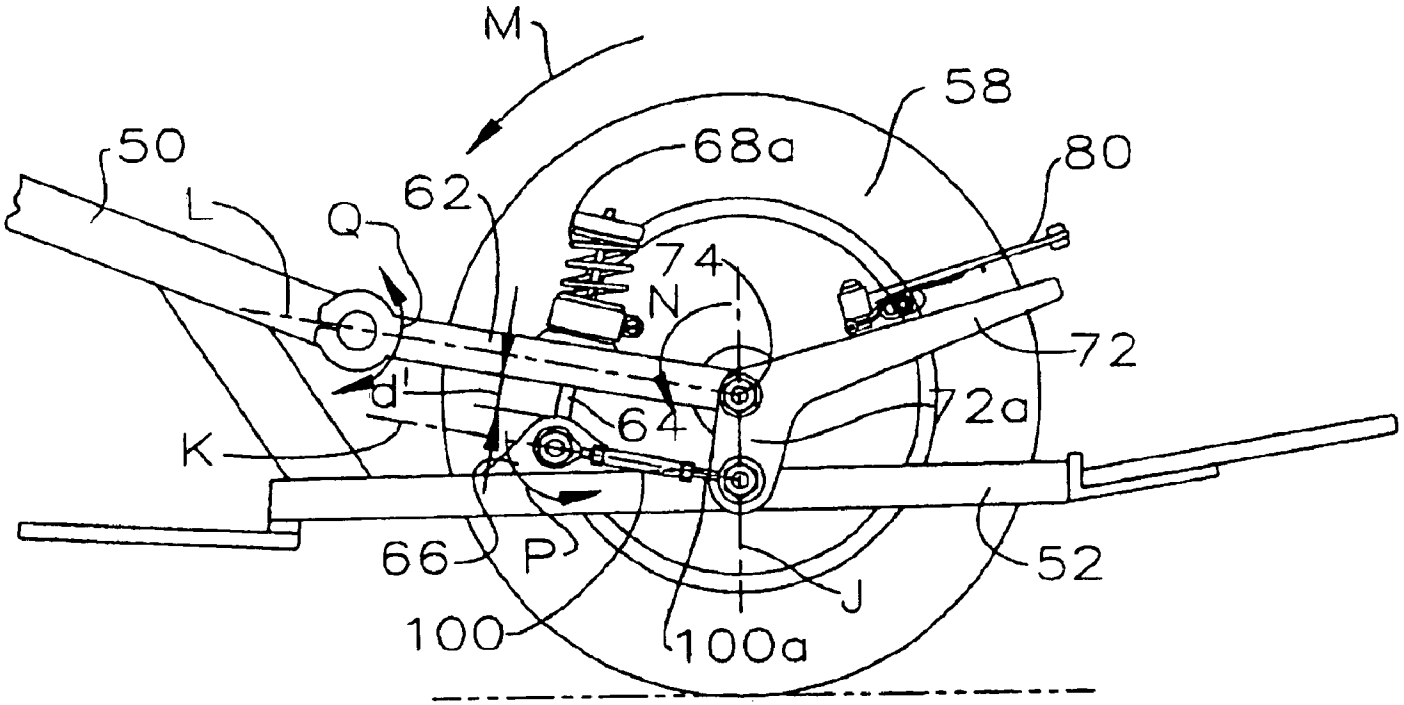
FIG. 6*a* is an enlarged, cut away left side elevation view of the rear wheel assembly.
Figure 7:
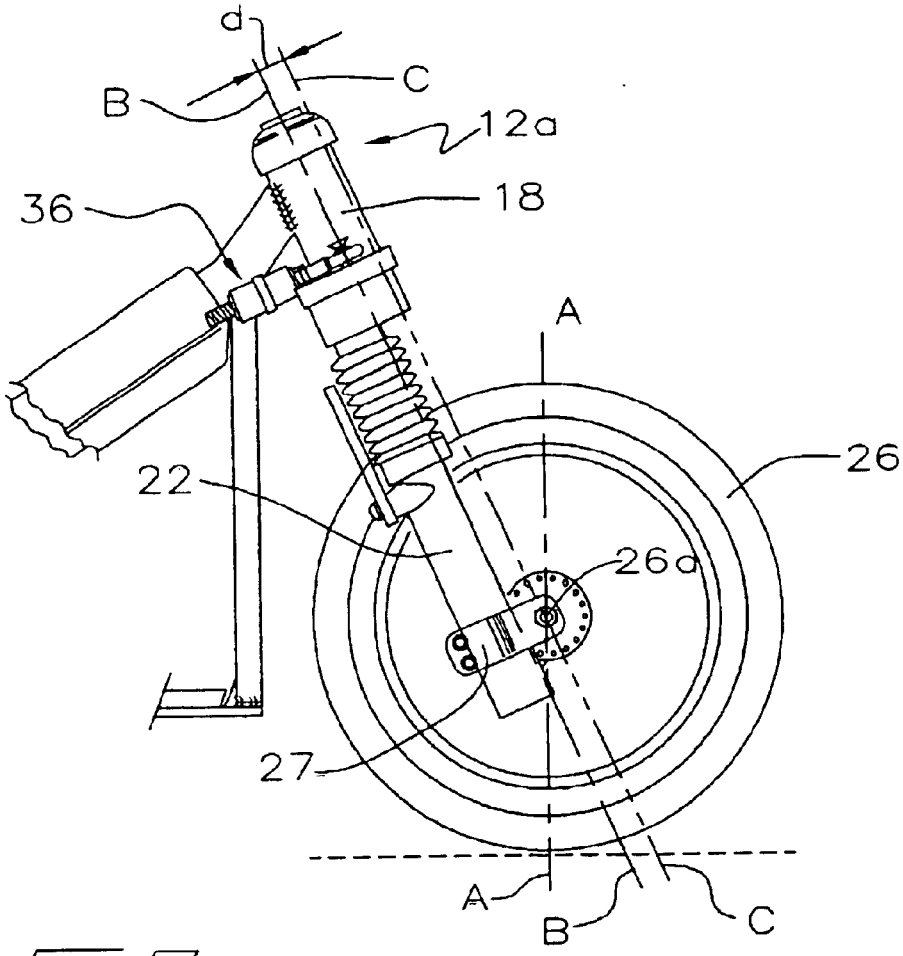
FIG. 7 is a partially cut away, enlarged view of the front wheel and front frame portion of the skateboard of FIG. 2.

As better seen in FIG. 4*b*, a progressive damping and centering device 36 is installed between the steerable front wheel 26 and the frame 12 of the skateboard. In one embodiment device 36 is mounted on only one side of the skateboard. The damping and centering device 36 may readily be changed from one side of the skateboard to the other at the preference of the rider, for example generally to the side opposite the rider's stance. The progressive damping and centering device 36 has a connecting shackle 38 at its leading end, which is pivotally mounted on to the upper surface of front forks 22. Shackle 38 may be mounted abreast of axis B of steering tube 18. A threaded rod 40 extends rearwardly from shackle 38 and passes through an elongated aperture in bracket 42. Bracket 42 is rigidly mounted to frame 12. A pair of threaded adjusting disks 44 are threadably mounted on threaded rod 40 on either side of bracket 42. Discs 44 enclose, sandwiched therebetween, a compressible resilient material 46 of progressive resiliency such as E.P.D.M. (bungee cord) rubber. The position of adjusting disks 44 on threaded rod 40 may be used to pre-compress the resilient material 46 against bracket 42. Such pre-compression reduces the available resiliency of material 46. This will then require more force to be exerted when turning the wheel. The positioning of discs 44 also may be used to align front wheel 26 in a straight-ahead position in line with frame 12.

Compressible material 46 may be comprised of a sandwich of material 46*a* immediately on either side of bracket 42 and material 46*b* which sandwiches material 46*a* against bracket 42 and is itself sandwiched between discs 44. Material 46*a* may be of a relatively soft, readily compressible material. Material 46*b* is preferably comprised of a harder, less resilient material. This sandwiched array of resilient materials permits progressive wheel control during a turn, whether to left or right of the frame, with the initial rotation of the front wheel about axis B requiring less force and thus turning more easily than the rotation of the front wheel about axis B in a more sharp turn which requires a greater angular turning of the front wheel about axis B. In the reverse case, the wheel is returned to a centered position progressively; more forcefully to return initially from a sharp turn, and less forcefully as the front wheel returns to center. Turning of the front wheel about axis B is controlled by shifting of the weight of the rider relative to the frame and rotation of the frame about its longitudinal axis in the manner of turning conventional skateboards.

A strut 50 extends diagonally downwardly from steering tube 18 to a pair of parallel, horizontally disposed frame members 52. Frame members 52 define a rear wheel-well portion of frame 12. Front and rear footpads 14 and 16 respectively, are securely mounted to the front and rear of frame members 52. Strut 50 may be enclosed in padding material 54 to protect the riders' shin. The footpads may have a textured non-slip top surface.

Frame members 52 extend rearwardly of the rear wheel 58 so as to support rear footpad 16 rearwardly of rear wheel 58. The rear footpad may be elevated approximately 1 inch above that of the front footpad and may be slightly angled rearwardly upwards. The center of mass of the skateboard is generally near the trailing edge of the forward footpad.

Trailing swing arms 62 are pivotally mounted to the aft end, on either side of, strut 50 and extend rearwardly therefrom, above and in vertical alignment with each of horizontal frame members 52. The axle for rear wheel 58 is mounted to the distal ends 62*a* of each swing arm 62. The front and rear wheel axles are positioned above the plane of the front and rear footpads. Swing arms 62 have apertures adjacent the rear wheel axle, for the through-passage of shock absorber connecting rods 64. The forward ends of tie rods 100 are pivotally mounted to brackets 66 which are mounted to frame members 52. The aft ends of tie rods 100 are pivotally mounted to the lower end of a "U" shaped rear brake mounting bracket 72, and permits limited movement of trailing swing arms 62 relative to the frame 12 through a spring shock absorber 68 having an adjustable tensioning mechanism.

Bracket 72 extends around the rear portion of rear wheel 58. The ends of bracket 72 are pivotally mounted to the opposite ends of wheel axle 74. The rear wheel rotates about an axis of rotation D' corresponding to axle 74. Flange 72*a*, depending from brake mounting bracket 72 affords a point of connection for ends 100*a* of tie rods 100, the other end of which are mounted to bracket 66. Tie rods 100 are adjusted so that axes J are substantially vertical, and thus longitudinal axis K through tie rods 100 and longitudinal axis L through swing arm 62 are substantially parallel.

Figure 2:
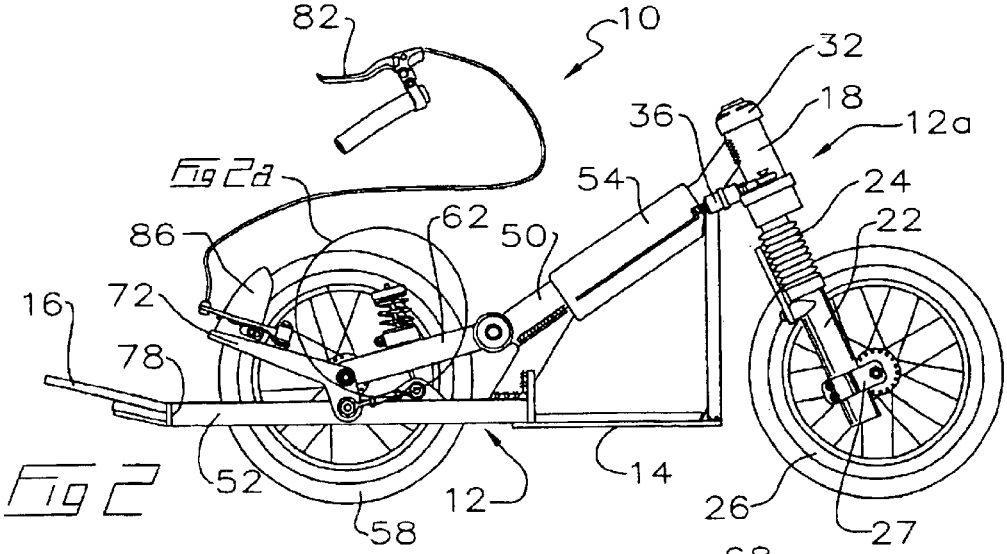
FIG. 2 is a right side elevation view of the skateboard of FIG. 1.
Figure 2A:
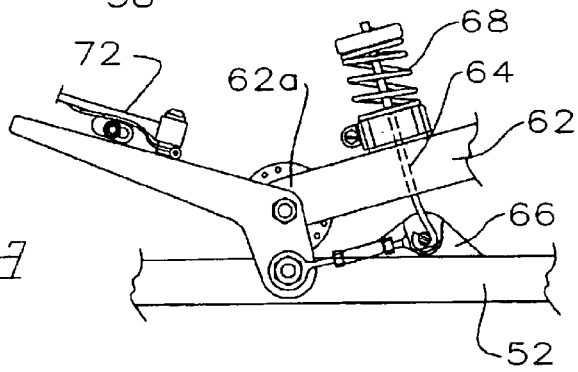
FIG. 2*a* is an enlarged partially cut-away portion of FIG. 2.
Figure 3:
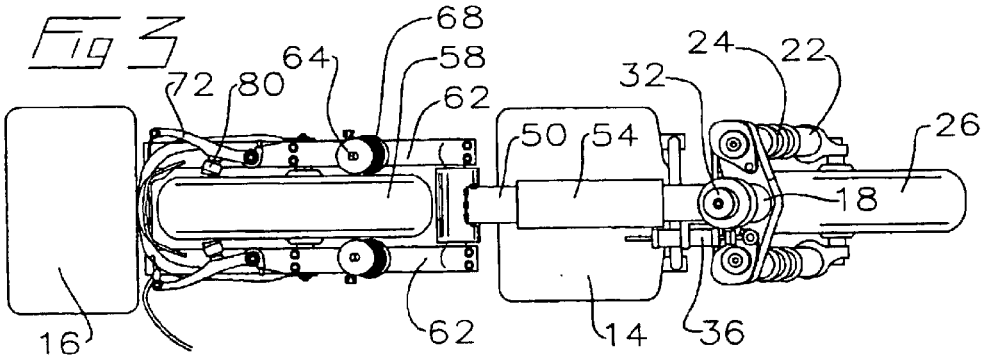
FIG. 3 is a plan view of the skateboard of FIG. 2.

Brake callipers 80, operated through a hand held brake actuating lever 82 seen in FIG. 2, are mounted on rear brake mounting bracket 72. Operating lever 82 bring brake pads 84 into frictional engagement with the side rims of rear wheel 58. The application of a braking force against rear wheel 58, which is rotating about its axle in direction M, results in a rotational moment in direction N acting on mounting bracket 72 urging rotation of tie rods 100 in direction P. Shock absorber 68 resiliently resists the pulling of rods 64 through the apertures in swing arms 62. Shock absorber 68 thus provides shock absorbing suspension by rotation of swing arms 62 in direction Q so as to reduce or lengthen distance d' (with the collapse or extension of spring 68*a*) even under conditions where the brakes are applied sufficiently to prevent wheel rotation. In an alternative embodiment only one shock absorber 68 and corresponding rod 64 is provided, mounted on one side, that is, on one of the pair of swing arms 62.

Figure 8B:
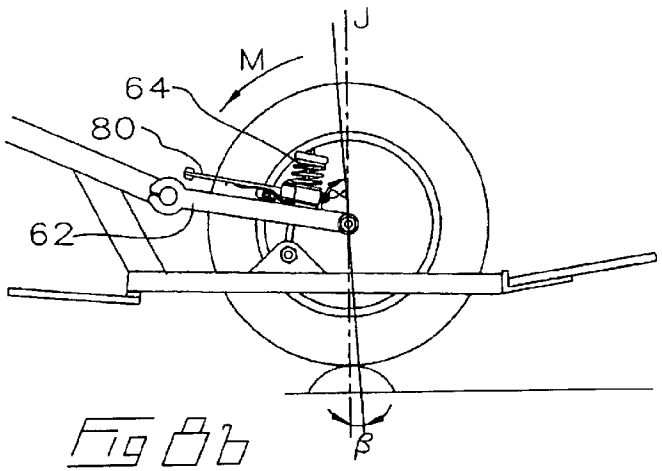
Fig 8b PRIOR ART
FIGS. 8*a* and 8*b* illustrate, in side elevation, a conventional rear wheel brake arrangement.
Figure 8A:
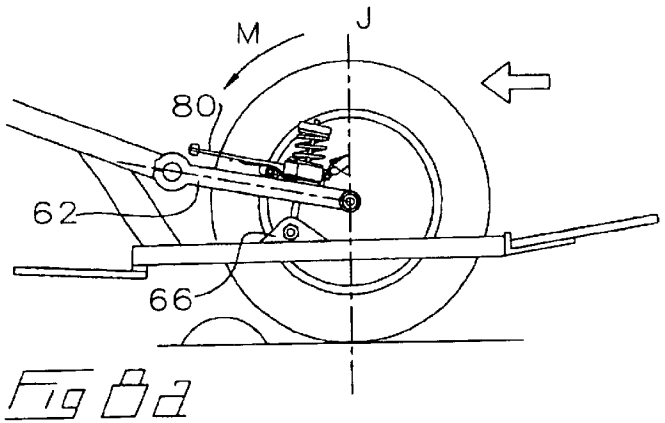
Fig 8a PRIOR ART
Figure 8D:
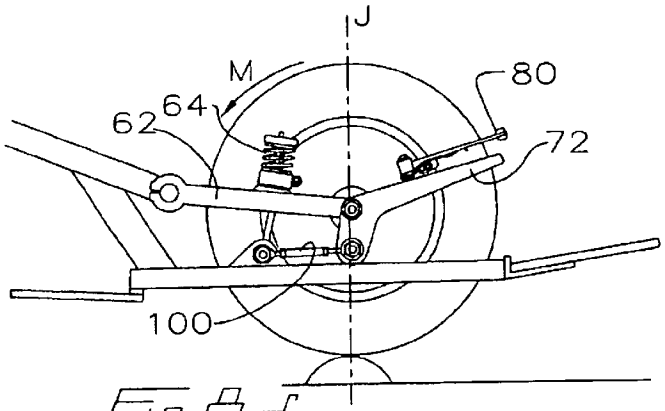
FIGS. 8*c* and 8*d* illustrate, in side elevation, the rear wheel brake system according to one aspect of the present invention.
Figure 8C:
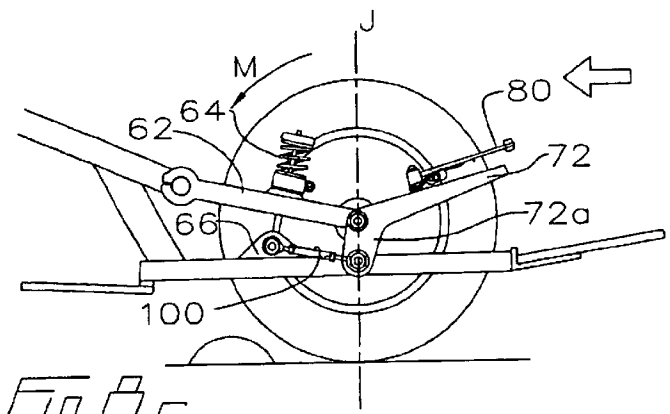

Although applicant does not want to be bound by any particular theory of operation of the present invention, the operation of the independent brake system according to one aspect of the present invention may be further understood by a review of FIGS. 8*a*–8*d*. FIGS. 8*a* and 8*b* illustrate how a conventional brake system works. FIGS. 8*c* and 8*d* illustrate how the present brake system works.

FIGS. 8*a* and 8*b* represent the problems encountered by a conventional brake system where brake callipers 80 are mounted to swing arms 62. FIG. 8*a* precedes FIG. 8*b* in time. FIG. 8*a* illustrates a board moving forward on smooth ground with braking force applied to wheel. M shows the wheel's direction of rotation. The angle between the vertical axis and the swing arm 62 is $\alpha$. Angle $\alpha$ is important because it demonstrates how the wheel corresponds to the swing arm while the brakes are engaged on smooth ground. The vertical axis is important because it demonstrates where the wheel contacts the ground.

FIG. 8*b* represents the same board only moments after FIG. 8*a*. The brakes are still being applied and the rear wheel has now reached the bump. The force of the bump has caused swing arms 62 to arc upwards/backwards and compress shocks 64. Angle $\alpha$ no longer lines up with the vertical axis. The resulting difference between angle $\alpha$ and the vertical axis is known as angle $\beta$. Therefore, we can see that the wheel has moved backwards in relation to the ground via the swing arm arc. Since the board is moving forward the natural tendency of the ground force is to roll the wheel forward in direction M and thus compress the shock.

Angle $\beta$ is where the problem lies with the conventional brake system. Angle $\beta$ is a problem because it must be eliminated so that the shocks can decompress and allow angle $\alpha$ to return to the vertical axis. The distance the tire moved to produce angle β must be reclaimed. Therefore, the braking force coupled with the shock rebound force must exceed the apposing ground force before angle β can be eliminated and angle α can return back to the vertical axis.

In other words while the brakes are engaged and while the board is moving forwards either the rear wheel must roll backwards (opposite to direction of rotation M) or the board must move backwards before the shocks can decompress. This is impossible. Therefore, while the brakes are engaged and the shocks are compressed and the board is moving forward the suspension is rendered useless. In this state the shocks provide no absorption. Therefore, when a bump is hit the rear end will bounce and the shocks will decompress until touchdown. Upon touchdown the rear shock compresses and is not relieved until contact with another bump occurs. To solve this problem the tire movement which produces angle β must be eliminated.

FIGS. 8*c* and 8*d* illustrate the independent brake system of the present invention. Brake callipers 80 are attached to an independent brake bracket 72 that is pivotally mounted to the wheel axle. Tie rod 100 lies generally parallel to swing arms 62 and anchors brake bracket flange 72*a* to frame bracket 66.

FIG. 8*c* illustrates the board moving in a forward direction with brakes applied on smooth ground. M is the direction of wheel rotation. Notice that the vertical axis J intersects the wheel axle and the pivot point of tie rod 100. FIG. 8*d* is the same board still moving forward with the brakes still being applied. FIGS. 8*d* shows what happens to the wheel when bump forces are exerted on it. Swing arms 62 still arc backwards and upwards but the parallelogram effect of the independent brake system pivots the wheel in such a way that wheel movement in relationship to the ground has been minimalized. Of note in FIG. 8*d* is that, although the shocks have been compressed, the vertical axis J still closely intersect the wheel axle and tie rod 100 pivot point. Therefore, the additional wheel movement of the conventional brake system caused angle β has been eliminated. Consequently, the shocks ability to decompress after impact even while the brakes are being applied is greatly improved.

A small fender 86 may also be firmly mounted on to brake mounting bracket 72 so as to protect the rear foot of the rider from abrasion from the aggressive tread on the rear tire and from debris spun outwardly from the tire.

Figure 1A:
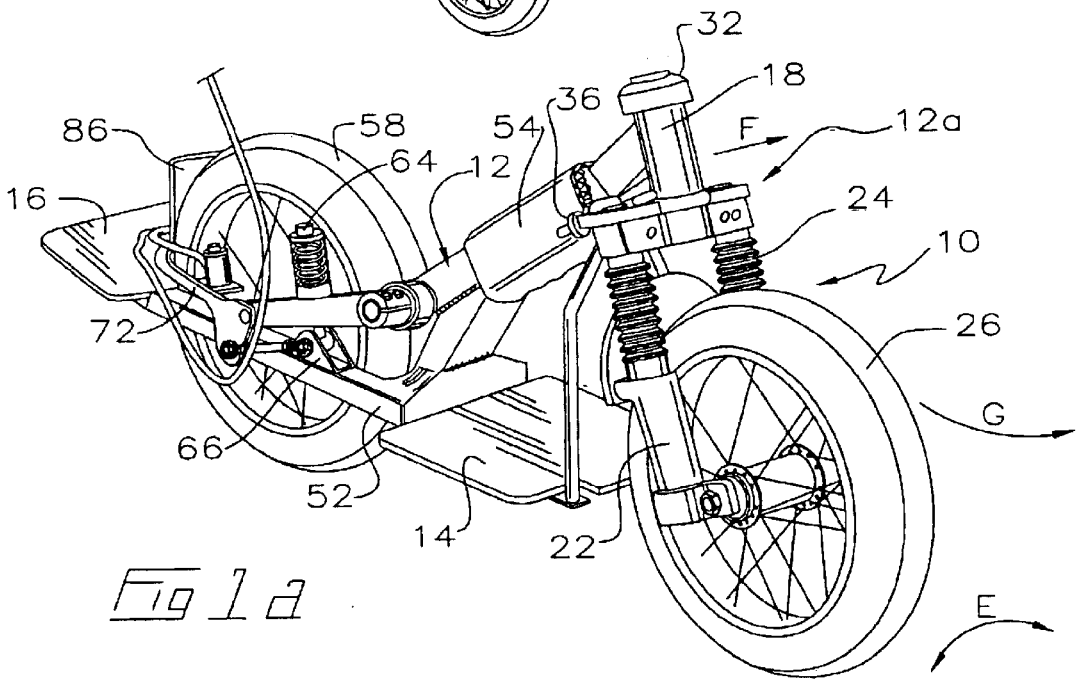
FIG. 1*a* is an enlarged perspective view of the skateboard of FIG. 1.

In operation the rider shifts the rider's weight laterally relative to the skateboard so as to tilt the skateboard in direction E relative to the ground. While the skateboard is translating forwardly so that front wheel 26 is rolling forwardly, tilting the skateboard to one side will result in the front wheel also slightly turning so as to point to that side. Thus, using the example of FIGS. 4 and 4*a*, the steering rotation of wheel 26 by angle α has been caused by the rider tilting the skateboard to the left, shown as direction F in FIG. 1*a*, so as to cause the skateboard to turn in direction G, it is thought at least in part due to the coupled rotational motion of the wheel. When the rider's weight is once again centered, centering device 36 urges and assists the return of wheel 26 back to a centered alignment in line with frame 12.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An in-line wheel, a terrain skateboard comprising:

an elongate rigid frame having a forward member, said forward member having a front end and an opposite rear end, laterally spaced apart pair of rigid struts defining a rear wheel well therebetween is rigidly mounted to said rear end, so as to extend rearwardly from said forward member, a headset rigidly mounted to the forward end of said forward member, at least one front fork rotatably mounted to said headset for rotation about a front fork axis of rotation, a front wheel rotatably mounted to said at least one front fork for rotation about a front wheel axis of rotation, said front wheel axis of rotation orthogonal to and offset forwardly from said front fork axis of rotation, said front fork axis of rotation inclined at an inclination angle rearwardly from said front wheel, a resilient turning-resistance means for resiliently resisting said rotation of said at least one front fork about said front fork axis of rotation, said turning-resistance means mounted in cooperation between said at least one front fork and said forward member of said frame, a pair of swing arms pivotally mounted at first ends thereof to said rear end, above said pair of rigid struts, so as to extend rearwardly from said forward member, a rear wheel rotatably mounted to an opposite second end of said pair of swing arms, said rear wheel for rotation about a rear wheel axis of rotation, said rear wheel axis of rotation substantially orthogonal to said swing arms, rigid fore and aft foot platforms mounted, respectively, between said front and rear wheels and rearwardly of said pair of rigid struts, said fore and aft foot platforms mounted below said front wheel axis of rotation and said rear wheel axis of rotation.

2. The device of claim 1 further comprising a brake mounting bracket mounted to said second ends of said pair of swing arms, a wheel brake mounted to said brake mounting bracket.

3. The device of claim 2 wherein said brake mounting bracket is pivotally mounted to said second ends.

4. The device of claim 3 wherein said wheel mounting bracket extends downwardly from said second ends to lowermost ends, and wherein a pair of parallelogram members are pivotally mounted at a forward end thereof to said pair of rigid struts and pivotally mounted at opposite rearward ends to said lowermost ends, said pair of parallelogram members extending substantially in parallel to said pair of swing arms.

5. The device of claim 4 further comprising at least one resilient shock absorber mounted in cooperation between at least one swing arm of said pair of swing arms and a corresponding at least one parallelogram member of said pair of parallelogram members.

6. The device of claim 5 wherein said shock absorber is mounted to said at least one parallelogram member where said parallelogram member is mounted to a corresponding strut of said pair of rigid struts.

7. The device of claim 4 further comprising at least one resilient shock absorber mounted in cooperation between at least one swing arm of said pair of swing arms and a corresponding strut of said pair of rigid struts.

8. The device of claim 7 wherein said shock absorber is mounted to said corresponding strut where a corresponding parallelogram member of said pair of parallelogram members is mounted to said corresponding strut.

9. The device of claim 6 wherein said shock absorber includes a resilient biasing means cooperating with a shaft, said resilient biasing means resiliently biasing said shaft upwardly, said shaft mounted at a lower end to said corresponding strut and at an upper end to said resilient biasing means.

10. The device of claim 9 wherein said at least one swing arm has a substantially vertical bore therethrough, said resilient biasing means mounted atop said bore and said shaft journalled through said bore.

11. The device of claim 8 wherein said shock absorber includes a resilient biasing means cooperating with a shaft, said resilient biasing means resiliently biasing said shaft upwardly, said shaft mounted at a lower end to said corresponding strut and at an upper end to said resilient biasing means.

12. The device of claim 11 wherein said at least one swing arm has a substantially vertical bore therethrough, said resilient mounting means mounted atop said bore and said shaft journalled through said bore.

13. The device of claim 1 wherein said resilient turning-resistance means includes means for exerting a first degree of resistance during rotation of said headset through a first rotational range of motion about said front fork axis of rotation, and means for exerting a second degree of resistance, greater than said first degree of resistance, during rotation of said headset through a second rotational range of motion about said front fork axis of rotation when rotated past said first rotational range of motion, said second rotational range of motion being greater than said first rotational range of motion.

14. The device of claim 1 wherein said front fork axis of rotation is inclined rearwardly by said inclination angle from the vertical, and wherein said inclination angle is substantially in a range of angles between fifteen and thirty degrees.

15. The device of claim 14 wherein said inclination angle is substantially twenty-two degrees.

* * * * *